US007648602B1

(12) United States Patent
Koppes et al.

(10) Patent No.: US 7,648,602 B1
(45) Date of Patent: Jan. 19, 2010

(54) REAGENTS FOR HYPERGOLIC IGNITION OF NITROARENES

(75) Inventors: William M. Koppes, Adelphi, MD (US); David M. Rosenberg, Bryans Road, MD (US); Kerry A. Clark, La Plata, MD (US); Eric S. Schlegel, Indian Head, MD (US); Brian W. Vos, Silver Spring, MD (US); Jody W. Lang, Waldorf, MD (US); Andrea D. Warren, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/650,755

(22) Filed: Dec. 15, 2006

(51) Int. Cl.

| | |
|---|---|
| ***C06B 27/00*** | (2006.01) |
| ***C06B 25/04*** | (2006.01) |
| ***D03D 23/00*** | (2006.01) |
| ***D03D 43/00*** | (2006.01) |

(52) U.S. Cl. ..... 149/105; 149/87; 149/108.4; 149/108.6; 149/108.8; 149/109.4; 149/120; 149/121; 149/124

(58) Field of Classification Search ..... 149/105, 149/87, 108.4, 108.6, 108.8, 109.4, 120, 149/121, 124

See application file for complete search history.

(56) References Cited

U.S. PATENT DOCUMENTS

| | | | | |
|---|---|---|---|---|
| 5,936,184 | A | 8/1999 | Majerus et al. | 89/1.13 |
| 6,401,591 | B1 | 6/2002 | Ross et al. | 89/1.13 |
| 6,695,938 | B2 * | 2/2004 | Diede | 149/1 |
| 6,748,842 | B1 | 6/2004 | Guirguis | 89/1.13 |
| 2003/0145925 | A1 * | 8/2003 | Kingma et al. | 149/46 |
| 2005/0009702 | A1 * | 1/2005 | Keifer | 504/128 |

OTHER PUBLICATIONS

A.Tulis, J. Keith, W.Sumida, D. Heberlein, "Non-Explosive Destruction of TNT with Hypergols", Fourth International Pyrotechnic Seminar, Denver Research Ins., 17.1-32, 1974.

A.Tulis, T. Labus, J. Keith, W.Sumida, D. Heberlein, "Hypergolic Fluid Jet Mine Neutralization", Final Technical Report, Con. No. DAAK02-72-C-0466, IIT Research Ins. Nov. 1975.

A.Tulis, J. Keith, W. Sumida, S.Mainer,"Delivery Systems for Chemical Neautralization of TNT Landmines".Final Tech Report, Con. No. DAAK02-75-C-0007, IIT Research Ins. Apr. 1976.

Tulis, et al., "Hypergolic Fluid Jet Destruction of Land Mines", Ninth Symposium on Explosives and Pyrotechnics, Franklin Ins, 29, 1-12, 1976.

Heberlein, et al., "Use of Chlorine Trifluoride for the Complete Neutralization of RDX", International Pyrotechnic Society, Seminar 16, Jonkoping, Sweden, 1991.

Mukundan, et al., "Mass Spectrometic and Spectroscopic Investigations of the Chemical Senitization of Nitro Compounds by an Amine". Proc. Am. Phys. Soc. Conf., 7th, 1992.

Tulis, et al."Hypergolic Chemical Initiation of Non-Detonative AutoCatalyicSelf-Consumption/Destruction of TNT, RDX, TNT-Based Exsploives", Conf., Fed Repubic Germany. 1996.

Patel, et al."In-Situ Landmine Neutralization Using Chemicals to Initate Low Order Burning of Main Charge" International Pyrotechnics Seminar, Jul. 2002, Westminster, CO.

* cited by examiner

*Primary Examiner*—Jerry Lorengo
*Assistant Examiner*—James E McDonough
(74) *Attorney, Agent, or Firm*—Fredric J. Zimmerman

(57) ABSTRACT

A method for chemically neutralizing a nitroarene explosive uses a nitroarene hypergol having an α,ω-amine and an accelerant that is applied to the explosive composition to cause ignition of the explosive composition. The method may be used to neutralize active mines.

19 Claims, No Drawings

REAGENTS FOR HYPERGOLIC IGNITION OF NITROARENES

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

The present invention pertains to improved reagents for the hypergolic ignition of nitroarene explosive compositions for chemical neutralization of the nitroarene explosive, particularly for mine neutralization applications.

2. Brief Description of the Related Art

Various explosive devices are known, such as unexploded ordnance, bombs, and mines, presenting a hazard to people and property. Such mines include anti-personnel or anti-vehicle land mines, or underwater mines designed to destroy or damage surface or submarine vessels. Unexploded ordnance (UXO), such as armed aerial bombs or shells, also presents a threat to people and property. Disarming or removing these explosive devices is a hazardous procedure. One method of neutralizing these explosive devices includes the use of hypergolic substances to ignite the explosive composition within the device. Identification of reagents effective in causing the ignition of trinitrotoluene (TNT), i.e., hypergols, has included interhalogens such as chlorine trifluoride and organometallics such as diethyl zinc. These reagents cause rapid ignition of the TNT, but are corrosive or pyrophoric. The use of diethylene triamine and ethylene diamine has been disclosed for use in destruction of an explosive device, such as in U.S. Pat. No. 5,936,184 to Majerus et al., for "Devices and Methods for Clearance of Mines or Ordinance".

There is a need in the art to provide improved formulations for chemical neutralization of nitroarene explosive compositions. The present invention addresses this and other needs.

SUMMARY OF THE INVENTION

The present invention includes a method for chemically neutralizing a nitroarene explosive composition comprising the steps of providing a nitroarene hypergol having an α,ω-amine and an accelerant, and applying the nitroarene hypergol to the explosive composition, wherein ignition of the explosive composition occurs. The method provides a chemically neutralized mine product.

The present invention also includes a nitroarene hypergol comprising an α,ω-amine and an accelerant.

DETAILED DESCRIPTION

The present invention provides a method and composition for efficiently decomposing/neutralizing and rendering harmless explosive compositions with a hypergolic formulation of an α,ω-amine and an accelerant. As such, the present invention includes a method for chemically neutralizing a nitroarene explosive composition using a nitroarene hypergol having an α,ω-amine and an accelerant and applying the nitroarene hypergol to the explosive composition, causing ignition of the explosive composition. The present invention provides improved reagents for the hypergolic ignition of TNT and explosive compositions containing this TNT or other nitroarene. These reagents are effective over a large range of particle sizes and surface areas of the nitroarenes, achieving a high degree of reliability in chemical mine neutralization applications. Formulations may include liquid or solid hypergolic composition, preferably with additives to enhance flow and wetting characteristics. As used herein, the term "hypergolic" includes igniting spontaneously upon contact with the complementary explosive substance.

The α,ω-amine of the nitroarene hypergol of the present invention may include linear polyamines having from about 2 to about 12 carbon atoms, and more particularly from about 2 to about 6 carbon atoms, optionally with nitrogen or other heteroatom within the structure of the compound. Representative linear polyamines of the present invention include α,ω-amines such as diethylenetriamine (DETA), ethylene diamine (EDA), propanediamine, butanediamine, pentanediamine, 2-methylpentanediamine, hexanediamine, and combinations thereof. In an exemplary embodiment, the α,ω-amine of the present invention includes diethylenetriamine, ethylene diamine, or combinations thereof, with diethylenetriamine most particularly.

Diethylenetriamine (DETA), also known as N-(2-aminoethyl)-1,2-ethanediamine), has a molecular weight of 103.17 and CAS Registry Number of 111-40-0, with a chemical structure shown below:

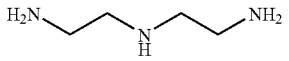

Ethylene diamine (EDA), also known as 1,2-ethylenediamine or 1,2-diaminoethane, has a molecular weight of 60.1 and CAS Registry Number of 107-15-3, with a chemical structure shown below:

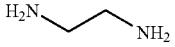

Propanediamine, also known as 1,3-propanediamine, has a molecular weight of 74.12 and CAS Registry Number of 109-76-2, with a chemical structure shown below:

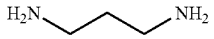

Butanediamine, also known as 1,4-diaminobutane, has a molecular weight of 88.2 and CAS Registry Number of 110-60-1, with a chemical structure shown below:

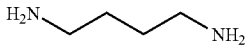

Pentanediamine, also known as 1,5-diaminopentane; 1,5-pentanediamine or pentamethylene diamine, has a molecular weight of 102.2 and a CAS Registry Number of 462-94-2, with a chemical structure shown below:

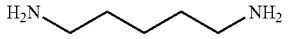

2-methylpentanediamine, also known as 1,5-diamino-2-methylpentane, has a molecular weight of 116.2 and CAS Registry Number of 15520-10-2, with a chemical structure shown below:

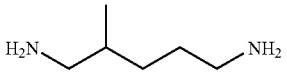

Hexanediamine, also known as hexamethylenediamine; HMDA; 1,6-diaminohexane or hexamethylenediamine, has a molecular weight of 116.2 and CAS Registry Number of 124-09-4, with a chemical structure shown below:

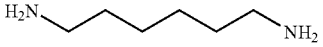

The accelerant of the nitroarene hypergol of the present invention may include appropriate hydridoborate salts ($M^+BH_4$), hydrazine, alkylated derivatives of hydrazine, and other salts of known hydridoborate anions including $B_3H_8^-$, $B_9H_{14}^-$, $B_{10}H_{13}^-$, $B_{10}H_{14}^{2-}$, $B_{10}H_{10}^{2-}$, $B_{12}H_{12}^{2-}$, and $B_{10}H_{15}^{6-}$ or combinations thereof. In an exemplary embodiment, the accelerant includes one or more borohydride or tetrahydridoborate salts, with representative borohydride salts including sodium borohydride salt, lithium borohydride salt, potassium borohydride salt, cesium borohydride salt, beryllium borohydride salt, barium borohydride salt, lanthanum borohydride salt, zirconium borohydride salt, vanadium borohydride salt, manganese borohydride salt, magnesium borohydride salt, calcium borohydride salt, rubidium borohydride salt, iron borohydride salt, cobalt borohydride salt, copper borohydride salt, zinc borohydride salt, mercury borohydride salt, aluminum borohydride salt, thallium borohydride salt, tin borohydride salt, lead borohydride salt, antimony borohydride salt, bismuth borohydride salt, silver borohydride salt and combinations thereof. In particular, among these are lithium borohydride salt, sodium borohydride salt, potassium borohydride salt, rubidium borohydride salt, cesium borohydride salt, beryllium borohydride salt, magnesium borohydride salt, calcium borohydride salt, strontium borohydride salt, barium borohydride salt and combinations thereof, with lithium borohydride salt, sodium borohydride salt, potassium borohydride salt and combinations thereof more particularly, and sodium borohydride salt most particularly. In an exemplary embodiment, the borohydride salts includes a metal salt having a valence of from about 1 to about 3.

Hydrazine accelerants include methylhydrazine, 1,1-dimethylhydrazine, 1,2-dimethylhydrazine, ethylhydrazine, 1,1-diethylhydrazine, and other like compounds.

The nitroarene hypergol may further include a flow enhancer that effectively aids in reducing the viscosity of the α,ω-amine and accelerant without compromising the hypergolic properties thereof. The flow enhancer is, in particular, ethanol, lower molecular amines having the composition of $H_2N(CH_2)_nNH_2$ with 1=n<6, glyme ethers of the composition $CH_3$—O—$(CH_2CH_2O)_nCH_3$ with n>1, and combinations thereof.

The nitroarene hypergol further may include an appropriate wetting enhancer that effectively aids in the dispersal of the α,ω-amine and accelerant around and into the nitroarene. Representative wetting enhancers include, for example, fluorocarbon surfactants, such as Zonyl fluorocarbon surfactants, FS300 and FSN, manufactured by DuPont Corporation of Wilmington, and combinations thereof. These non-ionic surfactants are ethoxylated/fluoroalkyl surfactants with ZONYL™ FSN being a 40% by weight solution of $F(CF_2CF_2)_{1-9}CH_2CH_2$—O—$(CH_2CH_2O)_xH$ in a 50% by weight solution of isopropanol in water where x=0 to about 25, ZONYL™ FSN 100 being $F(CF_2CF_2)_{1-9}CH_2CH_2$—O—$(CH_2CH_2O)_xH$ where x=0 to about 25, and ZONYL™ FS300 being a 40% by weight aqueous solution of a fluorinated surfactant.

When used, the nitroarene hypergol provides a decrease in the delay to ignition, relative to diethylenetriamine, of from about 90% or more. This significant delay is particularly useful in chemically neutralizing an active mine. Additionally, an increase in heat generation was found.

Representative nitroarene compounds that may be neutralized with the formulation of the present invention include, for example, nitrotoluenes, nitrobenzenes, nitronaphthalenes, nitrophenoxyalkyl nitrates, derivatives and substituted compounds, and combinations thereof. Nitroarenes include for example nitrotoluenes such as trinitro toluene (TNT), 2-4-nitrotoluenes, 3-4-nitrotoluenes, dinitrobenzenes, trinitro cresol, trinitroxylene, hexanitrodiphenylglycerol mononitrate. The formulation of the present invention is particularly useful for neutralization of nitroarenes such as dinitrotoluene, and particularly trinitro toluene (TNT).

The performance parameters of a number of reagents as hypergols were tested with TNT samples of known surface area, as determined by standard BET measurements. The hypergols were added as pure liquids or as mixtures with other liquid or solid hypergols and the delay-to-ignition (DTI) was measured. The hypergolic polar solutions were mixed with surfactant additives to increase the efficiency in wetting the surface of the nitroarene, and with ingredients to lower the viscosity, to also assist in maximizing the contact between the hypergol and the nitroarene. Blending of the liquid hypergols and the addition of solvents were used to modulate the viscosity and freezing points of the solutions. Systematic DTI experiments were performed to obtain structure/reactivity information on amine hypergols. These experiments, including the use of ab initio computations of the energies of possible reaction pathways, provided evidence for the mechanisms of the chemical reactions leading to ignition. Reaction intermediates were isolated from quenched reactions of several amines with TNT, and with other 1-substituted-2,4,6-trinitroarenes in order to further probe the structural features of the amines important to achieving a rapid reaction that would produce ignition. The first-formed intermediate was shown to be a Meisenheimer complex. In an unusual coupling with TNT, the amines with terminal amine groups (primary amines), i.e., α,ω-diaminoalkanes reacted at both amine functionalities to give a TNT-amine-TNT bridged product, with the amines attaching at the ring carbons of the TNT bearing the methyl group. DETA did this, leaving the central amine function unreacted. This observation guided the pursuit of these types of amines as efficient hypergols. To the extent that this bridging could be maximized on the surface of TNT, there would be an energy release compressed into the smallest time scale, a condition favoring the evolution and conservation of heat, and thus a decrease in delayed ignition. The α,ω-amines were indeed found to be superior hypergols as compared to other aminoalkanes. The blending of α,ω-amines with a varying number of carbon spacers, for example, in an embodiment, carbon spacers in a range of 2 to 6 carbons, between the terminal amines was adopted as a strategy to achieve a statistical advantage in rapidly forming the second links of the amine to another TNT molecule on the TNT surface. Thus, this configuration has the correct orientation for bonding at the ring carbon of the TNT bearing the methyl group.

Delay to Ignition Measurements

Hypergol efficacy was rated according to the delay between introduction of the hypergolic liquid and the first observation of ignition of the solid. In a representative experiment of adding DETA to TNT: 150 μL of DETA is introduced to 5.00 g of powdered TNT in a small glass vial via a pneumatically operated syringe mounted above the vial. Time zero was marked at the time of liquid delivery and the delay to ignition (DTI) was recorded as the amount of time elapsed between time zero and the first visible flame. A number of different candidate materials were tested in this manner, their efficacy determined by how each compared with the DTI observed for DETA.

EXAMPLE 1

A 5.0% (by weight) solution of sodium borohydride ($NaBH_4$) in DETA was tested as described above, and produced a DTI 0.19 as long as DETA by itself.

EXAMPLE 2

A 10.0% (by weight) solution of sodium borohydride ($NABH_4$) in DETA was tested as described above, and produced a DTI 0.06 as long as DETA by itself.

EXAMPLE 3

A 5.0% (by weight) solution of 1,6-diaminohexane in DETA was tested as described above, and produced a DTI 0.11 as long as DETA by itself.

Review of Examples 1-3

The hypergolic solutions of the present invention have superior performance when compared with previously known hypergolic amines in laboratory determinations of DTI values. The DTI of DETA/TNT, for example, is decreased by over 95% with the addition of an accelerant. This high performance is achieved without the use of pyrophoric or highly corrosive hypergols. Additionally, nitroarenes such as dinitrotoluene that fail to ignite with the previously known hypergolic amines were successfully ignited when a borohydride salt accelerant was dissolved in the α,ω-amines. Explosive mine compositions containing a mixture of TNT and a nitramine, where the nitroarene content is about 40%, may also be ignited, i.e., neutralized, with borohydride/amine solutions.

EXAMPLE 4

Formation of Nitroarene Hypergolic of Ammonia/Borohydride and 50/50 EDA/DETA

Procedure: Ammonia (4.9 mL, 3.76 g) was condensed into a graduated finger tube that was cooled by a dry ice/isopropanol slurry. The tube was then connected to a 100-mL 3-neck round bottom flask fitted with a condenser, thermocouple, and stirbar, and connected to a $N_2$ bubbler. $NaBH_4$ (3.0 g) and a 50/50 diethylenetriamine (DETA)/ethylene diamine (EDA), referred to as EDA/DETA, mixture (3.0 g) were added to the reaction flask, the condenser and reaction flask were both cooled by dry ice/isopropanol. The cooling bath was removed from the finger flask, and the liquid ammonia was slowly vapor-transferred into the reaction flask. The reaction was slowly allowed to warm. When the reaction contents reached −18° C., the contents were broken up with a spatula and the mixture was stirred until the resulting turbid solution reached room temperature (19° C.). The flask was connected to an oil bubbler and the excess $NH_3$ was allowed to evaporate through the bubbler until no more gas escaped through the bubbler. The reaction flask was connected to a mercury manometer and the vapor pressure was measured at 0.2 cm Hg at 19° C. The flask was weighed, and the mass of $NH_3$ was determined to be 1.84 g. The solution was transferred by pipette into a vial and stored in the refrigerator.

The results are shown in Table 1 below.

TABLE 1

| | |
|---|---|
| $NaBH_4$ | 3.0 g |
| 50/50 EDA/DETA | 3.0 g |
| $NH_3$ | 1.84 g |
| % $NaBH_4$ | 38% |
| % Amine | 38% |
| % $NH_3$ | 24% |
| VP at 19° C. | 0.2 cm Hg |

As seen in Example 4, a nitroarene hypergol having an α,ω-amine of EDA and DETA (50/50) and an accelerant of sodium borohydride was formed.

Delivery methodologies of a chemical composition for neutralization of a mine have been disclosed, such as in U.S. Pat. No. 5,936,184 to Majerus et al. for "Devices and Methods for Clearance of Mines or Ordinance", in U.S. Pat. No. 6,401,591 to Ross et al. for "Neutralization Chemical Injection Penetrator", in U.S. Pat. No. 6,748,842 to Guirguis for "Darts Containing Explosives for Defeating Buried Mines", with the disclosure of each herein incorporated by reference as applicable methodologies for the delivery of the nitroarene hypergol of the present invention for neutralization of a mine.

Exemplary embodiments of the present invention provide for highly improved nitroarene hypergols based on blends of α,ω-amines with accelerants such as borohydride salts and hydrazine (or alkylated derivatives thereof). These compositions include stable liquid compositions of sodium borohydride dissolved in equal parts of ammonia or ammonia admixed with selected α,ω-amines. Viscosity may be modulated to increase performance by use of materials such as ethanol or the lower molecular amines in the series $H_2N(CH_2)_nNH_2$, where n>1 in the blends of the α,ω-amines. The surface tension of the blends of the α,ω-amines may be decreased by addition of appropriate fluorocarbon surfactants, such as <1% of the DuPont Zonyl fluorocarbon surfactants. As seen in Table 2, below, a table of the quantitative effects of surfactants on the surface tension of DETA (in dynes/cm) is shown.

TABLE 2

Surface Tension Data for Venom Penetrator Samples

| Room Temp (° C.) | Sample[1] | Trial # (h(cm)) 1 | 2 | 3 | 4 | Average | Surface Tension[2] (dynes/cm) |
|---|---|---|---|---|---|---|---|
| 25 | DETA | 3.5 | 3.5 | 3.5 | 3.5 | 3.5 | 113.618 |
| 25 | 0.2% FS300 | 3.3 | 3.3 | 3.3 | 3.3 | 3.3 | 107.126 |
| 25 | 1% FS300 | 2.6 | 2.1 | 2.7 | 2.6 | 2.5 | 81.156 |
| 25 | 3% FS300 | 2.0 | 2.0 | 2.0 | 1.9 | 2.0 | 64.113 |

TABLE 2-continued

Surface Tension Data for Venom Penetrator Samples

| Room Temp (° C.) | Sample[1] | Trial # (h(cm)) 1 | 2 | 3 | 4 | Average | Surface Tension[2] (dynes/cm) |
|---|---|---|---|---|---|---|---|
| 18 | DETA | 3.6 | 3.6 | 3.6 | 3.6 | 3.6 | 116.864 |
| 18 | 0.2% FSN | 3.6 | 3.5 | 3.5 | 3.5 | 3.5 | 114.430 |
| 18 | 1% FSN | 3.3 | 3.1 | 2.8 | 2.8 | 3.0 | 97.387 |
| 18 | 3% FSN | 1.8 | 1.8 | 1.8 | 1.8 | 1.8 | 58.432 |
| 18 | DETA | 3.5 | 3.6 | 3.6 | 3.6 | 3.6 | 116.053 |
| 18 | 0.2% FSO | 3.2 | 3.2 | 3.2 | 3.2 | 3.2 | 103.879 |
| 18 | 1% FSO | 2.4 | 2.4 | 2.4 | 2.4 | 2.4 | 77.910 |
| 18 | 3% FSO | 2.0 | 2.1 | 1.9 | 1.8 | 2.0 | 63.301 |
| 18 | 0.2% dimethylhydrazine | 3.6 | 3.6 | 3.6 | 3.6 | 3.6 | 116.864 |
| 18 | 5% dimethylhydrazine | 3.4 | 3.4 | 3.4 | 3.4 | 3.4 | 110.372 |
| 18 | 10% dimethylhydrazine | 3.2 | 3.2 | 3.2 | 3.2 | 3.2 | 103.879 |
| 22 | DETA | 3.5 | 3.5 | 3.5 | 3.5 | 3.5 | 113.618 |
| 22 | 5% Hydrazine | 3.5 | 3.5 | 3.6 | 3.6 | 3.6 | 115.241 |
| 22 | 10% Hydrazine | 3.6 | 3.6 | 3.6 | 3.6 | 3.6 | 116.864 |
| | dichloromethane[3] | | | | | | 30.410 |
| | acetone[3] | | | | | | 26.260 |

Notes:
[1]Samples are either neat DETA or a percent additive in DETA
[2]Surface tension determined by the formula:
y = surface tension (dynes/cm)
h = distance between menisci (cm)
r = radius of capillary (cm)
d = density of sample (g/cm$^3$) [1.325 g/cm$^3$ for DETA]
[3]Reference standard The foregoing summary, description, and examples of the present invention are not intended to be limiting, but are only exemplary of the inventive features which are defined in the claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for chemically neutralizing a nitroarene explosive composition, comprising:

providing a nitroarene hypergol having a plurality of α,ω-amine and an accelerant and a wetting enhancer; and applying the nitroarene hypergol to the explosive composition, wherein ignition of the explosive composition occurs.

2. The method of claim 1, wherein the nitroarene explosive composition is selected from the group consisting of nitrotoluenes, nitrobenzenes, nitronaphthalenes, nitrophenoxyalkyl nitrates, derivatives and substituted compounds thereof.

3. The method of claim 2, wherein the nitroarene explosive composition is a nitrotoluene.

4. The method of claim 3, wherein the nitrotoluene is trinitro toluene.

5. The method of claim 1, wherein each of plurality of the α,ω-amines is selected from at least one of diethylenetriamine, ethylenediamine, propanediamine, butanediamine, pentanediamine, 2-methylpentanediamine, and hexanediamine.

6. The method of claim 5, wherein the α,ω-amine comprises diethylenetriamine.

7. The method of claim 1, wherein the accelerant is selected from the group consisting of borohydride salts, hydrazine, alkylated derivatives of hydrazine, and combinations thereof.

8. The method of claim 7, wherein the accelerant is selected from the group consisting of borohydride, tetrahydridoborate salts, hydridoborate anion salts, and combinations thereof.

9. The method of claim 8, wherein the borohydride salts includes a salt selected from the group consisting of sodium borohydride salt, lithium borohydride salt, potassium borohydride salt, cesium borohydride salt, beryllium borohydride salt, barium borohydride salt, lanthanum borohydride salt, zirconium borohydride salt, vanadium borohydride salt, manganese borohydride salt, magnesium borohydride salt, calcium borohydride salt, rubidium borohydride salt, iron borohydride salt, cobalt borohydride salt, copper borohydride salt, zinc borohydride salt, mercury borohydride salt, aluminum borohydride salt, thallium borohydride salt, tin borohydride salt, lead borohydride salt, antimony borohydride salt, bismuth borohydride salt, silver borohydride salt and combinations thereof.

10. The method of claim 8, wherein the borohydride salts include a salt selected from the group consisting of metals having a valences of from about 1 to about 3.

11. The method of claim 10, wherein the borohydride salts include a salt selected from the group consisting of lithium borohydride salt, sodium borohydride salt, potassium borohydride salt and combinations thereof.

12. The method of claim 11, wherein the borohydride salts include a salt of sodium borohydride salt.

13. The method of claim 1, wherein the nitroarene hypergol further comprises a flow enhancer.

14. The method of claim 13, wherein flow enhancer is selected from the group consisting of ethanol, lower molecular amines having the composition of $H_2N(CH_2)_nNH_2$ with n>1, glyme ethers of the composition $CH_3$—O—$(CH_2CH_2O)nCH_3$ with n>1, and combinations thereof.

15. The method of claim 1, wherein the wetting enhancer comprises one or more fluorocarbon surfactants.

16. The method of claim 1, wherein the nitroarene hypergol provides a decrease in the delay to ignition, relative to diethylenetriamine, of from about 90% of more.

17. A chemically neutralized mine product produced by the method of claim 1.

18. A nitroarene hypergol, comprising:

a plurality of different aliphatic molecules, wherein each of said plurality of different aliphatic molecules comprises a linear polyamine where said linear polyamine comprises an α amine and an ω amine;

a borohydride salt accelerant, wherein said a amine and said ω amine are separated by a number of carbon spacers; and a wetting enhancer.

19. A nitroarene hypergol, comprising:

a plurality of aliphatic molecules, wherein each of said plurality of aliphatic molecules comprises an ω amine and an ω amine, and wherein each of said plurality of aliphatic molecules is selected from the group consisting of diethylenetriamine, ethylene diamine, hexanediamine and combinations thereof; and, an accelerant comprising sodium borohydride, wherein said plurality of aliphatic molecules is a blend of aliphatic molecules; and a wetting enhancer.

* * * * *